US007401659B2

(12) United States Patent
Hsu

(10) Patent No.: US 7,401,659 B2
(45) Date of Patent: Jul. 22, 2008

(54) POSITIONING STRUCTURE OF THE TRANSMISSION DEVICE OF A SCREW FASTENING APPARATUS

(75) Inventor: Ming-Chieh Hsu, Kaohsiung (TW)

(73) Assignee: Mobiletron Electronics Co., Ltd., Taichung Hsien (TW)

( * ) Notice: Subject to any disclaimer, the term of this patent is extended or adjusted under 35 U.S.C. 154(b) by 0 days.

(21) Appl. No.: 10/915,488

(22) Filed: Aug. 11, 2004

(65) Prior Publication Data

US 2006/0033002 A1 Feb. 16, 2006

(51) Int. Cl.
*B25B 23/04* (2006.01)

(52) U.S. Cl. ..... 173/4; 173/11; 227/136; 81/434; 81/57.37

(58) Field of Classification Search ..... 173/4, 173/11; 227/136, 119; 81/434, 435, 57.37
See application file for complete search history.

(56) References Cited

U.S. PATENT DOCUMENTS

| | | | | | |
|---|---|---|---|---|---|
| 4,014,488 | A * | 3/1977 | Potucek et al. | ..... | 226/6 |
| 5,083,483 | A * | 1/1992 | Takagi | ..... | 81/434 |
| 5,339,713 | A * | 8/1994 | Hou | ..... | 81/434 |
| 5,473,965 | A * | 12/1995 | Chen | ..... | 81/434 |
| 5,687,624 | A * | 11/1997 | Tsuge et al. | ..... | 81/439 |
| 5,899,126 | A * | 5/1999 | Fujiyama et al. | ..... | 81/434 |
| 5,974,918 | A * | 11/1999 | Nakagawa et al. | ..... | 81/434 |
| 5,988,025 | A * | 11/1999 | Sasaki et al. | ..... | 81/434 |
| 5,988,026 | A * | 11/1999 | Reckelhoff et al. | ..... | 81/434 |
| 6,412,370 | B1 * | 7/2002 | Hsu et al. | ..... | 81/57.37 |
| 6,601,480 | B1 * | 8/2003 | Habermehl | ..... | 81/434 |
| 7,032,482 | B1 * | 4/2006 | Hoffman | ..... | 81/434 |

FOREIGN PATENT DOCUMENTS

| | | | |
|---|---|---|---|
| DE | 20309492 | U1 | 6/2003 |
| EP | 0494486 | A1 | 7/1992 |
| EP | 06234246 | A1 | 11/1994 |
| JP | 04-115878 | A | 4/1992 |

* cited by examiner

*Primary Examiner*—Scott A. Smith
(74) *Attorney, Agent, or Firm*—Bacon & Thomas, PLLC

(57) ABSTRACT

A positioning structure of the transmission device of a screw fastening apparatus is disclosed. The transmission device includes a stopping block, gear body and a braking body. An elastic rim is positioned between the lateral side of the stopping block and the inner face of a mobile seat. The gear body is H-shaped structure and one lateral side is provided with a plurality of slanting holes for corresponding protruded blocks, and the other lateral side is provided with a plurality of engaging holes. One side of the seat plate of the braking body is protruded with a shaft for mounting with the gear body, and the stopping block and the elastic rim are mounted to the hole on the mobile seat, and the seat plate is provided with a plurality of engaging blocks to engage with the engaging holes of the gear body. The other lateral side of the seat plate corresponding to the center of the shaft is a slot to accommodate a spring urging a square-shaped board. The stopping block drives the gear body to rotate counter clockwise the engaging hole and the engaging block are engaged and the gear body will be driven to engage with the engaging block so as to prevent screw from shaking until the screw is firmly moved to the screw-in slot and the rotating shaft will precisely push in the screw.

1 Claim, 5 Drawing Sheets

POSITIONING STRUCTURE OF THE TRANSMISSION DEVICE OF A SCREW FASTENING APPARATUS

BACKGROUND OF THE INVENTION (a) Technical Field of the Invention

The present invention relates to a positioning structure of the transmission device of a screw fastening apparatus, and in particular, the positioning device preventing the screw from shaking until, the screw is pushed in.

(b) Description of the Prior Art

FIGS. 1, 2 and 3 disclose conventional screw fastening apparatus including a securing seat A, a rotating screw shaft B, a mobile seat C, a positioner D and a transmission device E. A power element (not shown) is used to drive the screw shaft B. If screw F1 is to be pushed into an article I, the positioner D has to press onto the article. When the screw F1 is locked to the article I, the positioner D is then removed. The drawback of the conventional fastening device is that the gear E11 on the gear body E1 cannot hold the weight of the screw F1 and therefore the screw F1 will shake before it is fastened. Thus the screw F1 cannot be precisely locked to a positioning point to allow the screw shaft B to push in the screw F1.

SUMMARY OF THE INVENTION

Accordingly, it is an object of the present invention to provide a positioning structure of the transmission device of a screw fastening device having a securing seat, a screwing rod, a mobile seat, a positioner, and a transmission device mounted within the mobile seat, characterized in that the transmission device includes a stopping circular block, gear body and a braking body, the stopping block has a center hole thereon for the insertion of the shaft of the braking body and one lateral circular face thereof has a slanting protruded block for the engagement with a plurality of recesses of the gear body, and between another lateral circular face and the inner face of the mobile seat, an elastic rim is provided, and the end face of the circular block is a guiding block having a screw hole for a rotating bolt to lock to, the circular block rotates together with the screw bolt so as to rotate the gear body and the gear body is H-shaped having two lateral sides provided with a plurality of teeth to move screws, and the center of the gear body has a hole for the insertion of the shaft of the braking body and one lateral side is provided with slanting holes arranged in a circle, the slanting holes is adapted for the protruded block on the braking block, the other lateral face of the gear body is provided with a plurality of engaging holes arranged in a circle, one side of the braking body has a square seat plate corresponding to the square plate, and one side of the seat plate is protruded with a shaft and the end head of the shaft is circular, on the seat plate a plurality of engaging blocks are provided and the engaging block is corresponding to the engaging hole of the gear block and the lateral side of the seat plate, corresponding to the center of the shaft is a slot for the urging of a spring, and the other end of the spring urges the square plate, and the shaft passes through the hole of the gear, the hole of the stopping block and the elastic rim then to the hole of the mobile seat, thereby when the mobile seat moves, the bolt is delivered to the arch-shaped path to drive the stopping block in clockwise direction, and the protruded block is moved away from the slanting hole until the block is corresponding to another slanting hole and the front end of the securing seat urges the shaft and the braking body moves by the spring and the engaging block and the engaging hole are dislocated, when the securing seat moves forward from the mobile seat, the slanting circular end head will not urge by the end face of the securing seat to protrude outside the hole of the mobile seat, and the rotating bolt moves forward with the mobile seat and restores at the arch-shaped slot and drive the stopping block to rotate counter clockwise, and the stopping block drives the gear body to rotate counter-clockwise and screws will be moved in sequence until the engaging hole of the gear body and the engaging block of the seat plates are in engagement, and the gear body is stopped at the engaging block so as to prevent the screw from shaking until the screw is firmly moved to the screw slot at the mobile seat and is fully stopped.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 2:
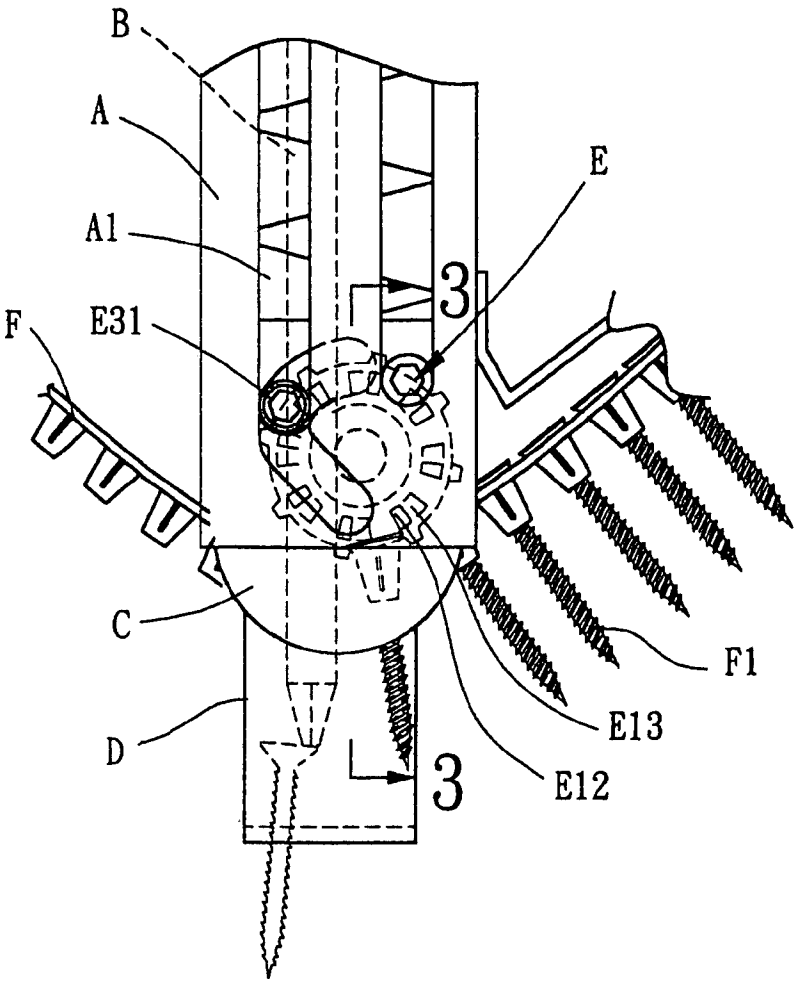
PRIOR ART FIG. 2
FIG. 2 is a schematic view of another conventional screw fastening device.
Figure 1:
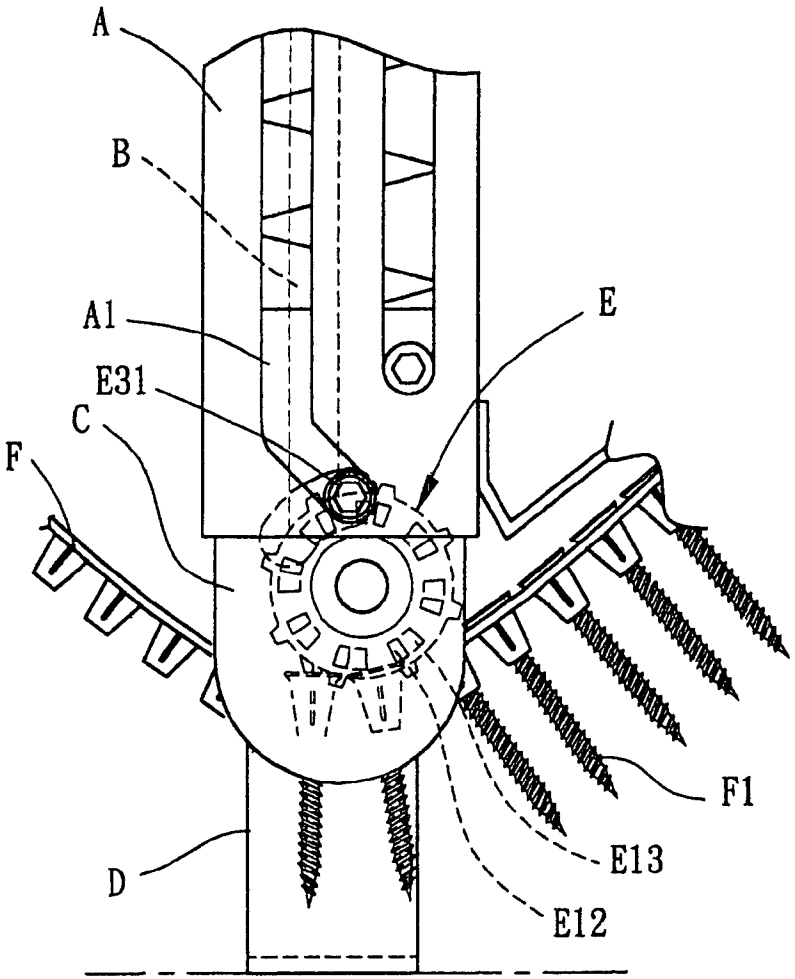
PRIOR ART FIG. 1
FIG. 1 is a schematic view of a conventional screw-fastening device.
Figure 3:
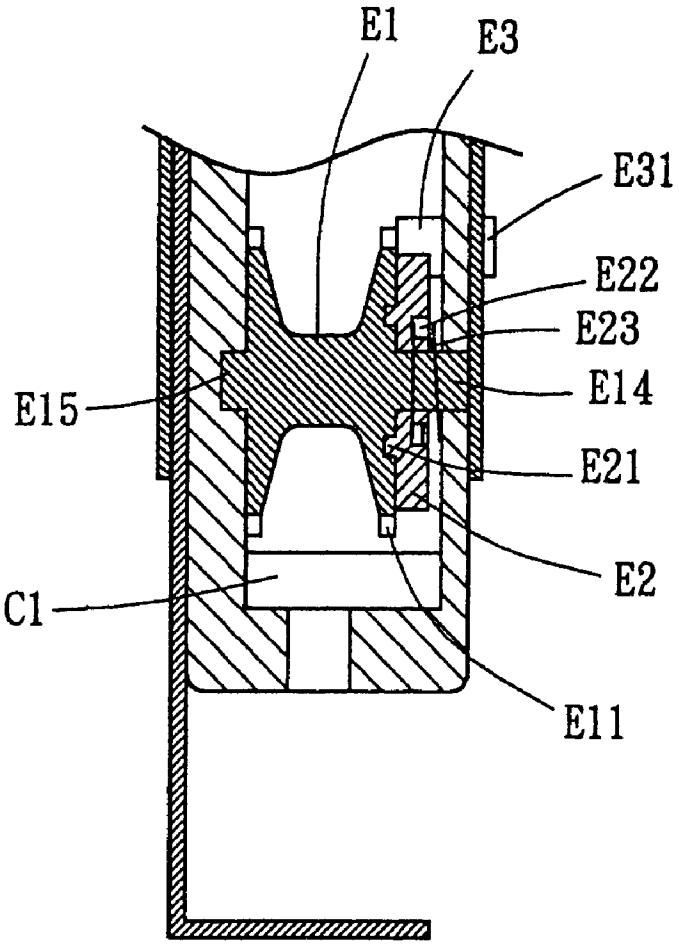
PRIOR ART FIG. 3
FIG. 3 is a sectional view along 3-3 of FIG. 2.
Figure 4:
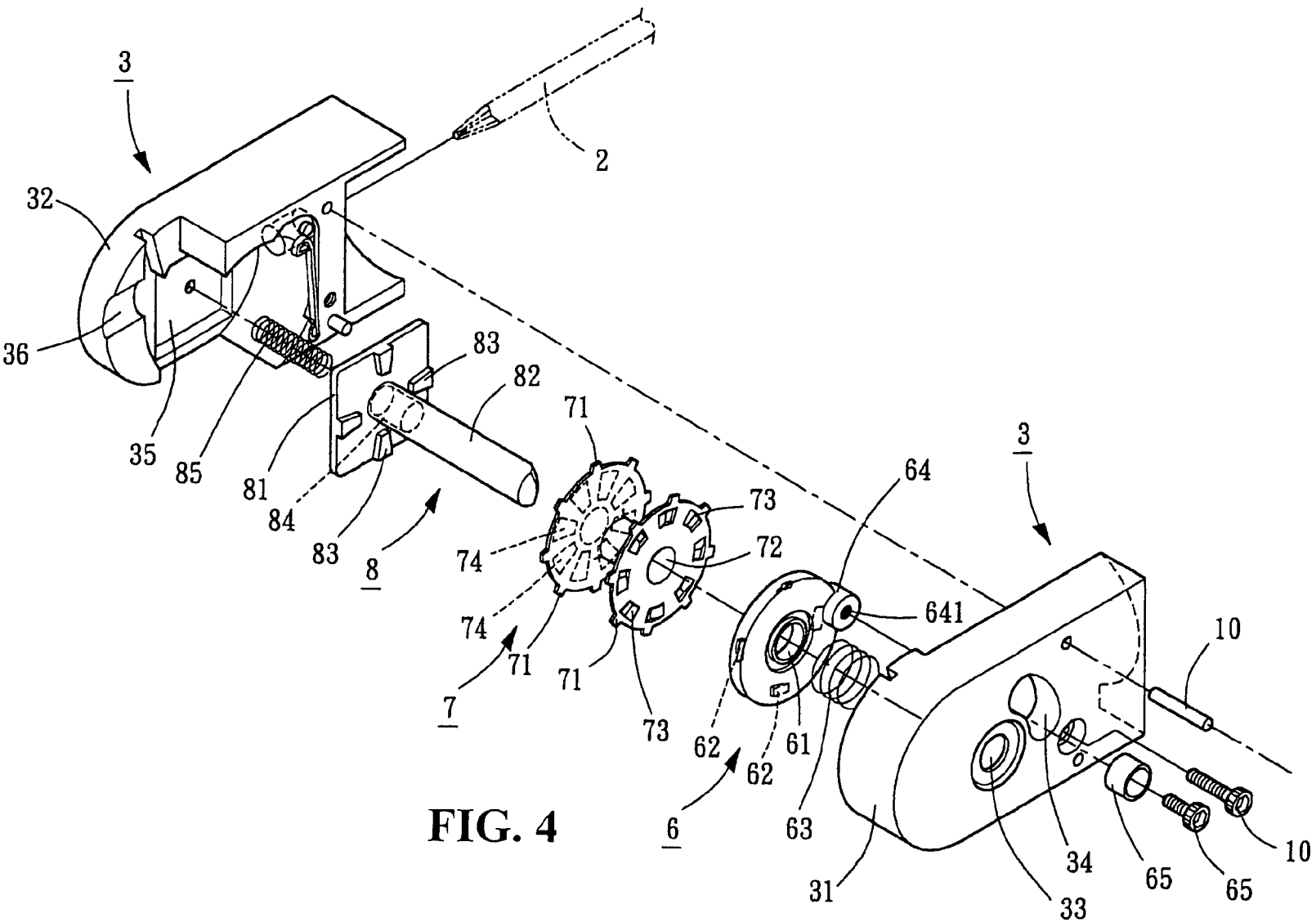
FIG. 4 is a perspective exploded view of a positioning structure of the transmission device of a screw fastening apparatus of the present invention.
Figure 6:
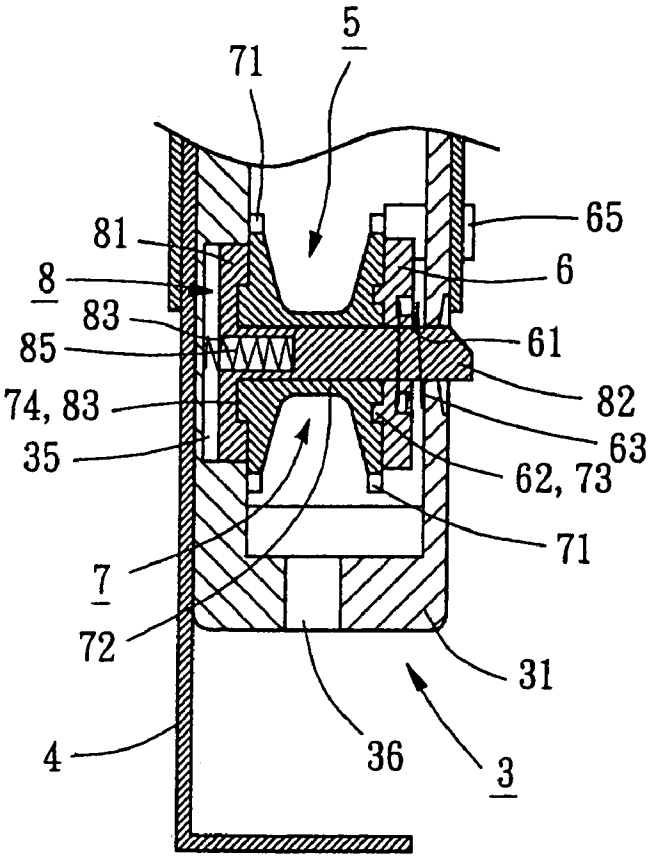
FIG. 6 is a sectional view along line 6-6 of the present invention.
Figure 5:
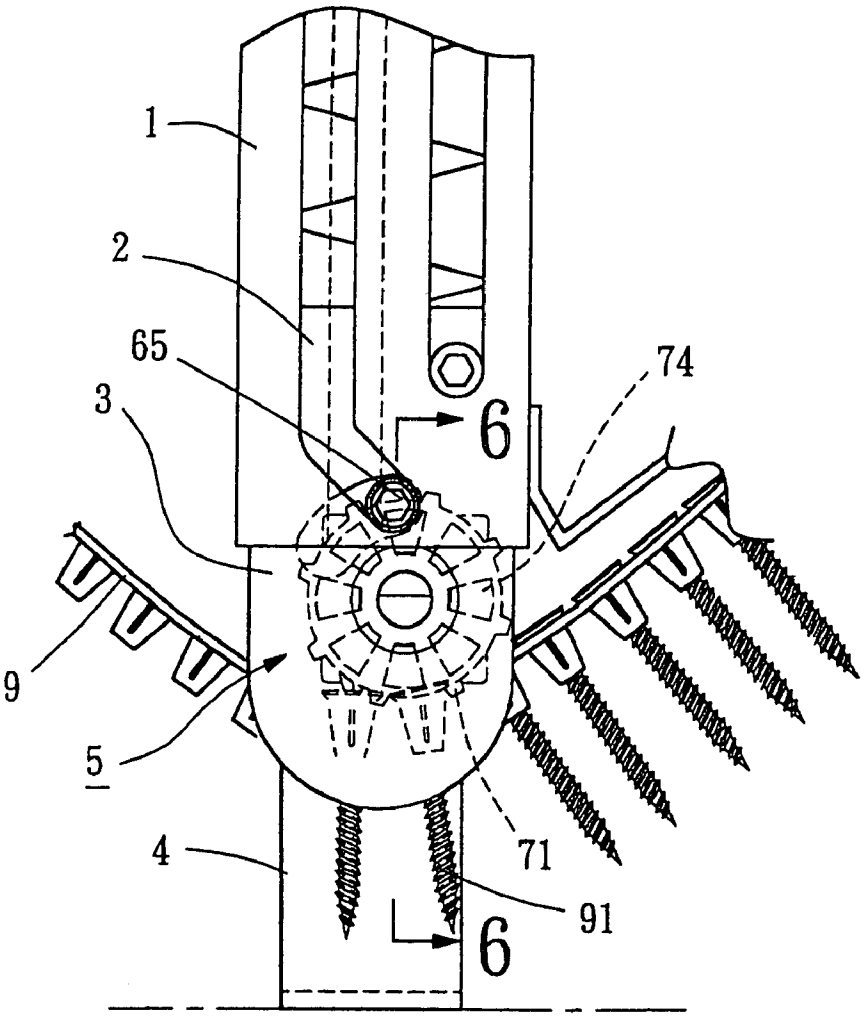
FIG. 5 is a schematic view showing the application of the positioning structure of the transmission device of a screw fastening apparatus of the present invention.

Referring to FIGS. 4, 5 and 6, there is shown a positioning structure of the transmission device of a screw fastening device having a securing seat 1, a screwing rod 2, a mobile seat 3, a positioner 4 mounted at the front end of the mobile seat 3, and a transmission device 5 mounted within the mobile seat 3. The transmission device 5 is positioned within the interior of the mobile seat 3 and the mobile seat 3 is formed from the connection of a left and a right seat body 31, 32. The transmission device 5 includes a stopping circular block 6, gear body 7 and a braking body 8. The stopping block 6 has a center hole 61 thereon for the insertion of the shaft 82 of the braking body 8 and one lateral circular face thereof has a slanting protruded block 62 for the engagement with a plurality of recesses 73 of the gear body 7, and between another lateral circular face and the inner face of the mobile seat 3, an elastic rim 63 is provided, and the end face of the circular block 6 is a guiding block 64 having a screw hole 641 for a rotating screw bolt 65 to lock into, and the circular block 6 rotates together with the screw bolt 65 so as to rotate the gear body 7. The gear body 7 is a H-shaped structure having two lateral sides provided with a plurality of protruded teeth 71 to move screws 91 on a screw belt 9, and the center of the gear body 7 has a hole 72 for the insertion of the shaft 82 of the braking body 8 and one lateral side is provided with slanting holes 73 arranged in a circle. The slanting holes 73 are adapted for the protruded block 62 on the stopping block 6. The other lateral face of the gear body 7 is provided with a plurality of engaging holes 74 arranged in a circle. One side of the braking body 8 has a square seat plate position 35 corresponding to the square seat plate 81, and one side of the seat plate 81 is protruded out with a shaft 82 and the end head of the shaft 82 is circular. On the seat plate 81, a plurality of engaging blocks 83 are provided and the engaging blocks 83 are corresponding to the engaging hole 74 of the gear block 7, and the lateral side of the seat plate 81, corresponding to the center of the shaft 82, is a slot 84 for the urging of a spring 85, and the other end of the spring 85 urges the square seat plate position 35, and the shaft 82 passes through the hole 72 of the gear body 7, the hole 61 of the stopping block 6 and the elastic rim 63, after that it passes through the hole 33 of the left seat body 31 of the mobile seat 3, thereby when the mobile seat 3 moves. A screw bolt 10 is used to connect the left and right side seat body 31, 32. Accordingly, these will allow the stopping circular body 6, the gear body 7 and the braking body 8 to connect to the interior of the mobile seat 3. The entire structure of the transmission device 5 and the mobile seat 3 is obtained.

As shown in FIG. 6, the positioner 4 is located at the front end of the mobile seat 3 and is moved with respect to the securing seat 1. The braking body 8 of the transmission device 5 is positioned at the square-shaped plate 36, and the shaft 82 passes through the hole 72 of the gear body 7 and the hole 61 of the stopping block 6. At this instance, the engaging holes 74 are engaged with the engaging block 83, and the slanting holes 73 are corresponding to the protruded blocks 62. The shaft 82 passes through the elastic rim 63 and the hole 33 of the left seat body 31 and is protruded outside so as to allow the mobile seat 3 to move backward. The end face at the front end of the securing seat 1 urges the slanting circular end head of the shaft 82 to move low, which causes the braking body 8 to move by the spring 85, and the engaging block 83 of the seat plate 81 is disengaged from the engaging holes 74. The slot 84 urges by the spring 85 and the other end of the spring 85 urges the square-shaped plate 35. Thus, when the transmission device 5 is at the interior of the mobile seat 3, the seat plate 81 forms a space with the square-shaped plate 35 for the braking body 8 to move. Further the circular lateral sides of the gear body 7 are provided with protruded teeth 71 allowing the upward movement by the screw belt 9, and the screw 91 is positioned at the screw-in slot 36 at the front end of the mobile seat 3 from bottom to top so as to allow the screw shaft 2 to fasten by rotation.

Figure 8:
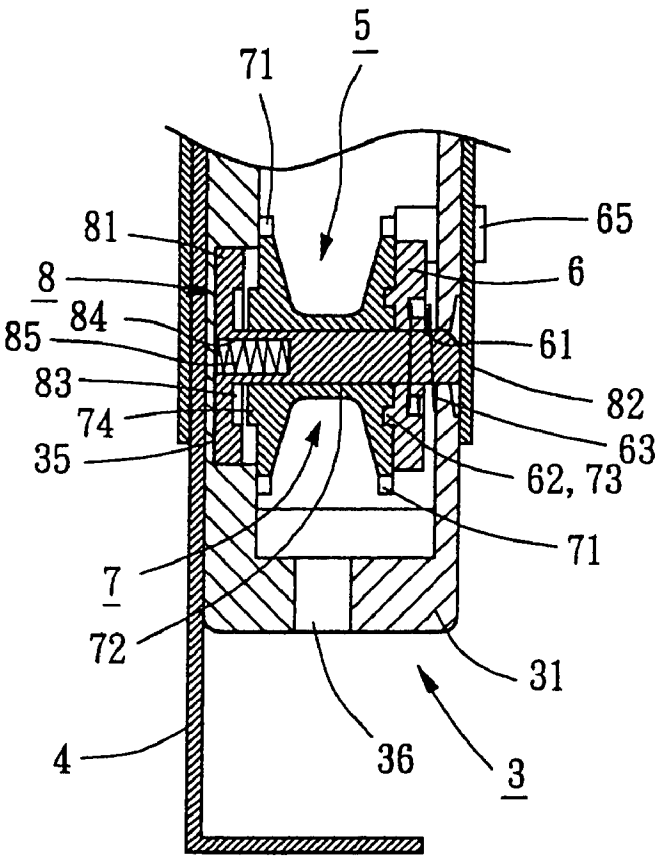
FIG. 8 is a sectional view along line 8-8 of FIG. 7.
Figure 7:
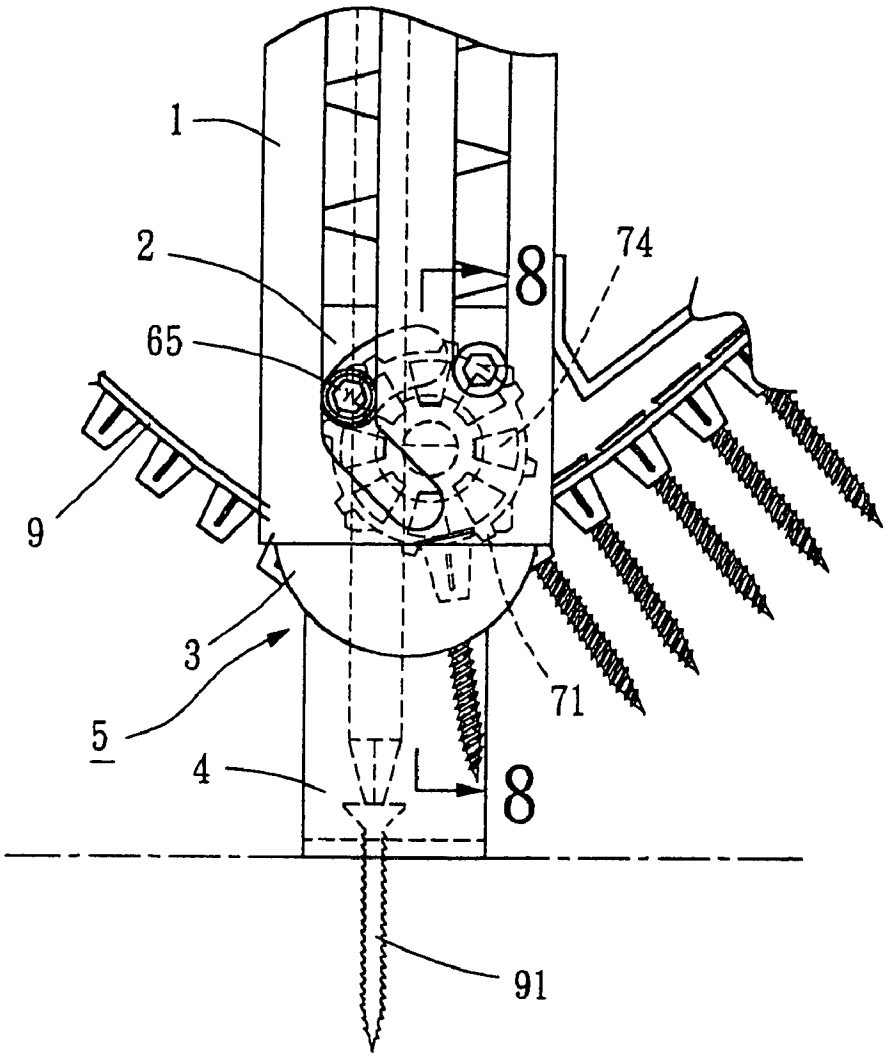
FIG. 7 is another schematic view showing the application of the positioning structure of the transmission device of a screw fastening apparatus of the present invention.

Referring to FIGS. 7 and 8, the operator loads the screw belt 9 at the bottom of the mobile seat 3 so that the hole at the lateral side of the screw belt 9 is corresponding to the protruded teeth 71 at the gear body 7. The positioner 4 urges the article 11 and at the same time, the fastening device (not shown) is pushed and the mobile seat 3 moves to the securing seat 1 until the front end of the securing seat 1 closes to the front end of the positioner 4. At this moment, the guiding block 64 of the stopping block 65 is connected to the rotating screw bolt 65, and the screw bolt 65 is positioned at the arch-shaped slot 34 of the mobile seat 3. When the mobile seat 3 moves to the securing seat 1, the screw bolt 65 is guided to the arch-shaped slot 34, and the braking block 6 rotates clockwise. The protruded blocks 62 are corresponding to the slanting slot 73, the stopping block 6 will drive the protruded block 62 to rotate clockwise and the protruded block 62 will rotate continuously by disengaging from the slanting hole 73 until the protruded block 62 corresponds to another slanting hole 73. At this instance the rotating screw bolt 65 is moved to another end of the slot 34 and the front end of the securing seat 1 urges the end head of the shaft 82 which causes the braking body 8 to move and the engaging block 83 disengages from the engaging hole 74. At this moment, the lateral side of the seat plate 81 can urge the square-shaped plate 35. When the end face of the securing seat 1 closes to the front end of the positioner 4, the fastening body is moved backward and the mobile seat 3 moves forward from the interior of the securing seat to restore to the shape before the fastening body is pushed. When the mobile seat 3 moves forward from the securing seat 1, the rotating screw bolt 65 will be moved with the mobile seat 3. At this instance, the screw bolt 65 will drive the stopping block 6 and the protruded block 62 rotates counter clockwise. At this instance, the protruded block 62 is corresponding to the slanting hole 73 and the counter clockwise rotating protruded block 62 is restricted by the shape of the slanting hole 73 and is not disengaged from the hole 73.

In other words, when the protruded block 62 at the slanting hole 73 rotates counter clockwise, the protruded block 62 will not be disengaged from the hole 73 so that the protruded block 62 urges the slanting hole 73 and the stopping block 6 will drive the gear body to rotate counter clockwise. At this instance, the protruded teeth 71 drive the screw belt 9 upward. When the gear body 7 rotates counterclockwise the engaging hole 74 will correspond to the engaging block 83. At this moment the mobile seat 3 moves forward and the end head of the shaft 82 will not urge by the end face of the securing seat 1 to move lower, and the braking body 8 is restored to move by the elastic force of the spring 85. The end head of the shaft 82 is protruded out of the hole 33 of the mobile seat 3, so that when the engaging hole 74 is corresponding to the engaging block 83, the seat plate 81 is at the square-shaped plate 35 which is stationary. Therefore the gear body 7 will not rotate counter-clockwise by the stopping block 6. The gear body 7 at this instance is stationary and the screw 91 on the screw belt 9 will move to the screw-in slot 36 for fastening.

In accordance with the present invention, the gear body 7 is engaged by the braking body 8 so that the screw belt 9 will not shake and the screw 91 can be firmly move to the screw-in slot 36 for positioning/fastening.

While the invention has been described with respect to preferred embodiments, it will be clear to those skilled in the art that modifications and improvements may be made to the invention without departing from the spirit and scope of the invention. Therefore, the invention is not to be limited by the specific illustrative embodiment, but only by the scope of the appended claims.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A transmission of a screw fastening device having a securing seat (1), a screwing rod, a mobile seat (3), a positioner, the transmission device mounted within the mobile seat (3) having a hole (33) and an arch-shape slot (34), the transmission comprising:

a braking body (8) having a square seat plate (81) having a first later side and a second lateral side, the first lateral side includes a plurality of engaging blocks (83), a shaft (82) having one circular end and one slanting circular end, which is a head of the shaft (82), a gear body (7) is of an H-shape having a first lateral side and a second lateral side, each of the lateral sides are provided with a plurality of teeth (71) to move screws, the gear body (7) having a hole (72) configured to accommodate the shaft (82), a plurality of slanting holes (73) arranged in a circle on a first lateral side of the gear body (7), a circular stopping block (6) having a center hole (61) for insertion of the shaft (82), an elastic rim (63), a guiding block (64) having a screw hole (641), the guiding block is disposed on an end face of the stopping block (6), the screw hole (641) is configured to accommodate a screw bolt (65), a plurality of slanting protruding blocks (62) disposed on a lateral circular surface of the circular stopping block (6) and configured to engage with the plurality of slanting holes (73) of the first lateral side of the gear body (7), wherein the circular stopping block (6) is configured to rotate together with the screw bolt (65) so as to rotate the gear body (7), the second lateral side of the gear body (7) includes a plurality of engaging holes (74) arranged in a circle, the engaging holes (74) are configured to engage with the engaging blocks (83) of the square seat plate (81), the second lateral side of the square seat plate (81) includes a slot (84) configured to accommodate an urging spring (85) urging the second lateral side of the square seat plate (81), and the shaft (82) passes through the hole (72) of the gear body (7), the center hole (61) of the circular stopping block (6), the square seat plate (81) of the braking body (8), the elastic rim (63), and the hole (33) of the mobile seat (3), wherein, in operation when the mobile seat (3) moves, the screw bolt (65) is actuated in the arch-shaped slot (34) to drive the stopping block (6) in clockwise direction, the slanting protruded blocks (62) are moved away from the slanting holes (73) until the slanting protruding blocks move to a next position corresponding to the slanting holes (73), a front end of the securing seat (1) urges the shaft (82), the braking body (8) moves by the spring (85) and the engaging block (83) and the engaging hole (74) are dislocated, when the securing seat (1) moves forward from the mobile seat (3), the slanting circular end head of shaft (82) will not be urged by the end face of the securing seat (1) to protrude outside the hole (33) of the mobile seat (3), the screw bolt (65) moves forward with the mobile seat (3) and restores at the arch-shaped slot (34) and drives the stopping block (6) to rotate counter clockwise, the circular stopping block (6) drives the gear body (7) to rotate counter-clockwise, wherein the screws are moved in sequence until the engaging hole (74) of the gear body (7) and the engaging blocks (83) of the square seat plate (81) are in engagement, and the gear body (7) is stopped at the engaging blocks (83) so as to prevent the each of the screws from shaking until the screw is firmly moved to a screw slot at the mobile seat (3) and is fully stopped.

* * * * *